US005191980A

United States Patent [19]

Boffito et al.

[11] Patent Number: 5,191,980

[45] Date of Patent: Mar. 9, 1993

[54] PROTECTIVE VESSEL FOR A GETTER MATERIAL

[75] Inventors: Claudio Boffito; Giuliano Fenati, both of Milan, Italy

[73] Assignee: SAES Getters SpA, Milan, Italy

[21] Appl. No.: 855,507

[22] Filed: Mar. 20, 1992

[30] Foreign Application Priority Data

Apr. 16, 1991 [IT] Italy ..... M191A001037

[51] Int. Cl.[5] ..... B65D 85/72

[52] U.S. Cl. ..... 206/524.4; 206/484; 220/359; 417/48

[58] Field of Search ..... 206/484, 497, 524.1, 206/524.4, 213.1; 417/48, 51; 220/359; 383/202

[56] References Cited

U.S. PATENT DOCUMENTS

| | | | |
|---|---|---|---|
| 3,207,295 | 9/1965 | Farrar | 417/48 |
| 3,225,910 | 12/1965 | Della Porta | 417/48 |
| 3,260,356 | 7/1966 | Garbe | 417/48 |
| 3,606,136 | 9/1971 | Hegardt | 220/359 |
| 4,124,659 | 11/1978 | Delle Porta et al. | 264/0.5 |
| 4,272,259 | 6/1981 | Patterson et al. | 417/48 X |
| 4,356,955 | 11/1982 | Schmit | 220/359 X |
| 4,938,667 | 7/1990 | Della Porta | 417/48 |
| 5,091,233 | 2/1992 | Kirby et al. | 206/524.8 X |

FOREIGN PATENT DOCUMENTS

| | | | |
|---|---|---|---|
| 2829871 | 1/1980 | Fed. Rep. of Germany | 206/484 |
| 515876 | 12/1939 | United Kingdom | 206/484 |

*Primary Examiner*—Bryon P. Gehman
*Attorney, Agent, or Firm*—David R. Murphy

[57] ABSTRACT

A protective vessel is provided for a getter material which comprises a first sheet of thermally stable material attached to an adhesive, which in turn is attached to a second sheet of thermo-retractable organic plastic material, the first and second sheets enclosing the getter material.

21 Claims, 2 Drawing Sheets

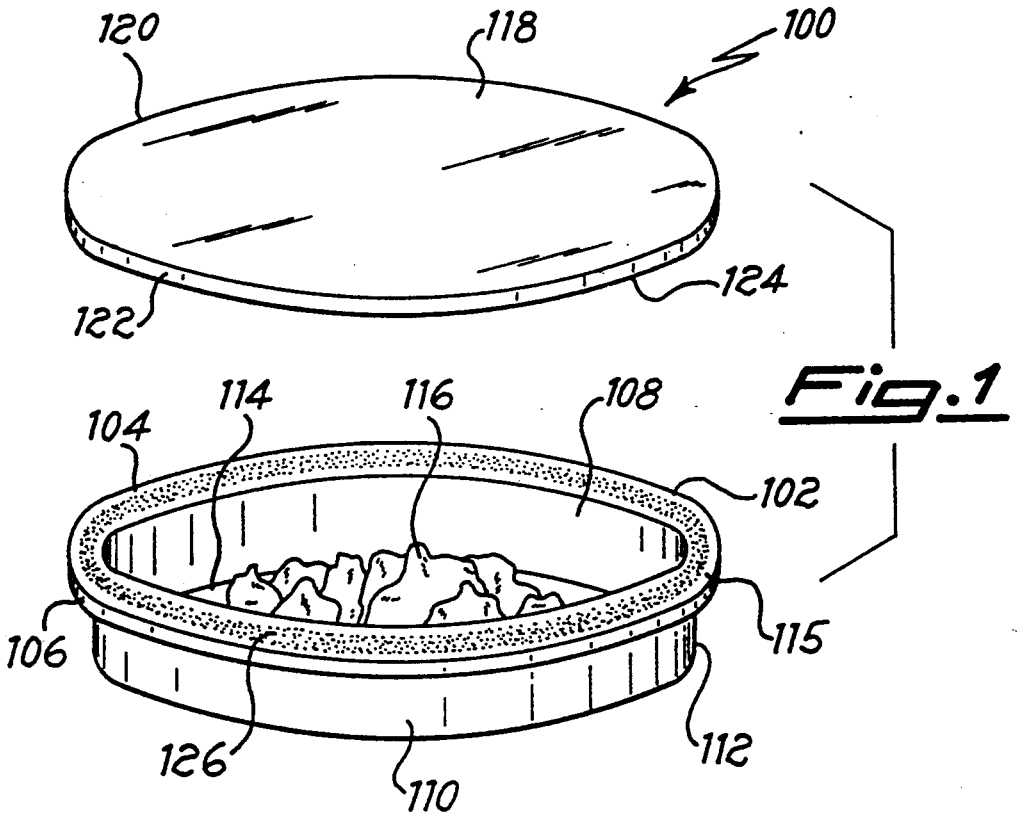
Fig. 1
Fig. 2
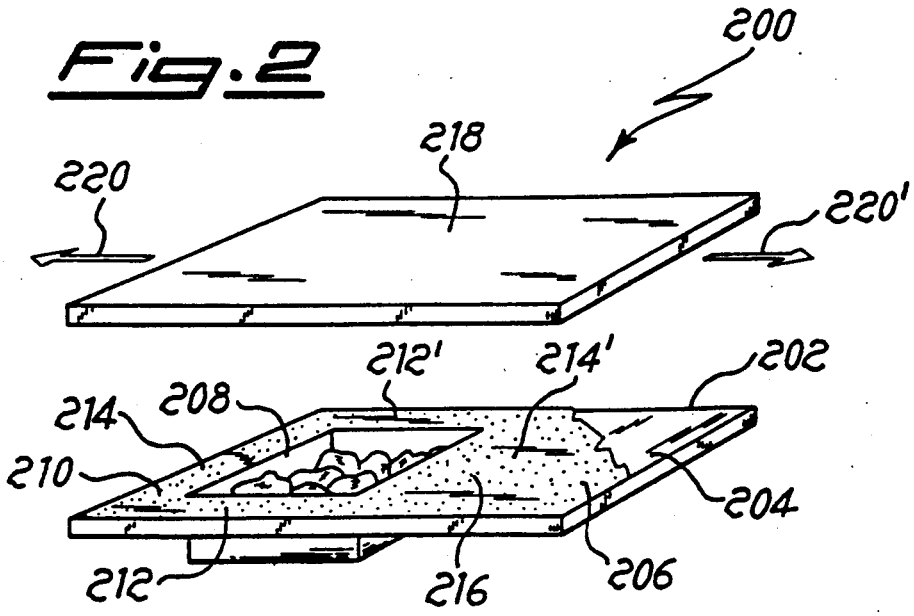

PROTECTIVE VESSEL FOR A GETTER MATERIAL

FIELD OF THE INVENTION

The present invention concerns a temporary protective vessel for a getter material.

BACKGROUND

Means for protecting getter materials have long been known in the art. Barium, when used as a metal in its elemental form was placed in a sheath of protective metal which guarded against attack by atmospheric gases. With the development of more sophisticated evaporated getter devices the very nature of the alloys used, such as $BaAl_4$, gave inherent protection since the alloys did not react with atmospheric gases. However such devices have to be heated to about 800°-1200° C. to cause release of barium metal and thus develop their reactive ability.

Non-evaporated getters also have a protection mechanism whereby they form protective layers on the surface of the gettering material. Nevertheless their protective layer must be removed by a thermal treatment, or by activation, at high temperature for a given time to enable the surface to become clean and to act as a gas scavenger. Even with low temperature activatable getter materials, this temperature still has to be raised to about 400° C., for the material to become active.

Protection has been afforded to these non-evaporated getters, after suitable activation, by the use of rupturable containers, such as in U.S. Pat. No. 4,124,659 to della Porta et al. or by the use of glass phials as in U.S. Pat. No. 4,938,667 to della Porta, the entire disclosures of both which are incorporated herein by reference.

BRIEF ADVANTAGES OF THE INVENTION

It is therefore an object of the present invention to overcome one or more of the disadvantages of prior art protective vessels for getter materials.

It is another object of the present invention to provide a protective vessel for getter materials which has reduced manufacturing costs.

It is a further object of the present invention to provide a protective vessel for getter materials which does not require temperatures above 150° C. for its use.

It is yet another object of the present invention to provide a protective vessel for getter materials which is both simple and efficient.

These and other objects and advantages of the present invention will become evident to those skilled in the art by reference to the following description thereof and drawings wherein:

BRIEF DESCRIPTION OF THE DRAWINGS

FIG. 1 is an exploded view of one embodiment of the present invention and,

FIG. 2 is a view of another embodiment of the present invention; and

DETAILED DESCRIPTION OF THE INVENTION

Figure 3:
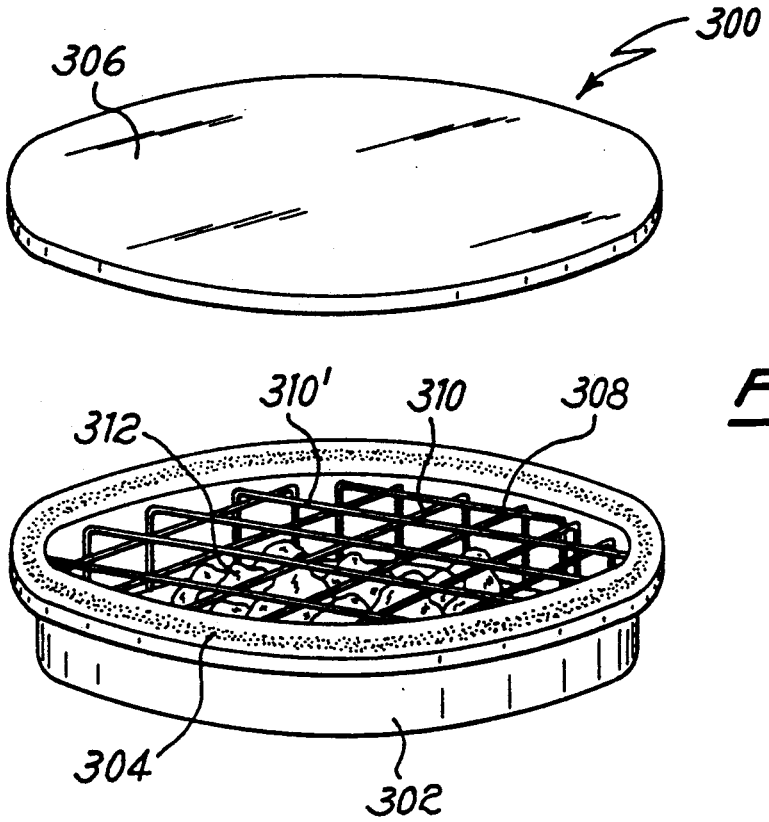
FIG. 3 is another exploded view of an embodiment of the present invention.

The present invention provides a protective vessel for a getter material which comprises a first sheet of thermally stable material which is attached to a layer of adhesive which in turn is attached to a second sheet of thermo-retractable organic plastic material; the first and second sheets enclosing said getter material.

With reference now to FIG. 1 there is shown an exploded view of a protective vessel 100 which comprises a first sheet 102 of thermally stable material 104 in the form of a first circular disc 106. Thermally stable material 104 can be any material suitable for use in a vacuum environment, with a low outgassing rate, but should preferably also have a low gas permeability. It may be of organic plastic such as polyethylene or polyvinylchloride (PVC) or polystyrene, or of an easily formed, but rigid material such as metal, for instance, a thin sheet of stainless steel, nickel or aluminium. The organic plastic may be coated with a thin film of metal (such as aluminium) or with other organic plastic films with reduced permeability to atmospheric gases to improve gas tightness of the package. Examples of these "barrier" materials are PVDC (vinylidene chloride copolymers) and EVOH (ethylene vinyl alcohol copolymers), which may be applied as a single coating or on top of the organic plastic or by coextrusion. Within first sheet 102 is press formed a hollow receptacle or depression 108 in the form of a shallow cylinder 110 which has an outer wall 112 and a bottom wall 114 leaving an annular boarder 115 in disc 106. Shallow cylinder 110 contains getter material 116. Any getter material that requires protection may be used such as barium or activated non-evaporated getter materials but the reactive non-evaporating barium getter alloys are particularly preferred.

Depression 108 and hence shallow cylinder 110 containing getter material 116, is sealed by means of a second sheet 118 of thermo-retractable organic plastic material 120 in the form of a second circular disc 122. Lower surface 124 of disc 122 is caused to adhere to annular boarder 115 by means of a glue 126. Glue 126 may be any adhesive suitable for causing the materials of the annular border 115 of the first sheet 102 to adhere to disc 122. The glue 126 could be a thermo-sensitive lacquer. A suitable lacquer is that sold by Società COMET of Lainate, Milan, Italy under the tradename VA276 which consists of a polyurethane resin dissolved in a solvent of ethyl acetate.

The lacquer or glue 126 is coated on border 115 and allowed to evaporate aided by a flow of warm air at about 40° C. until dry. It is caused to adhere by pressing the two parts together, that is the border 115 carrying glue 126 (lacquer) and disc 122 and applying heat at above room temperature but at a temperature less than the thermo-retraction temperature of disc 122.

Filling of shallow cylinder 110 with getter material 116, and the gluing procedure may take place in a glove box or other protective atmosphere. The preferred protective atmosphere is argon, which then fills the depression 108 and protects the getter material 116.

Referring now to FIG. 2 there is shown another preferred embodiment of temporary protective vessel 200 for protecting a reactive non-evaporating barium getter alloy from unwanted gas until exposure thereto. It comprises a first rectangular sheet 202 of thermally stable rigid polyvinylchloride. It has an upper surface 204 which is coated with a layer 206 of evaporated aluminium. Rectangular sheet 202 contains a rectangular depression 208 for containing the getter alloy. A border 210 is thus left in upper surface 204. The border 210 has four sides 212, 212', 212'', 212''' . First two sides 212, 212' are parallel to each other and are of substantially equal width. The other two sides 214, 214' are parallel to each other but one side 214' is of greater width. Upon, and attached to the layer 206 of evaporated aluminium and partially covering it is a thermo-sensitive lacquer 216 whose point of adhesion is above room temperature but less than the thermo-retraction temperature of a second rectangular sheet 218 of thermo-retractable organic plastic material. This second rectangular sheet 218 is of thermo-retractable organic plastic material which conforms with upper surface 204 of said first rectangular sheet 202. The direction of retraction, indicated by arrows 220, 220' being parallel with the two sides 212, 212' which are of substantially equal width. The thermo-sensive lacquer 216 is hermetically sealed and attached to second rectangular sheet 218. Upon heating the protective vessel 200 to a temperature of less than 150° C. the thermo-retractable organic plastic of the second rectangular sheet 218 retracts to expose the barium getter to residual gases. As side 214' is of greater width than side 214 the thermo-retraction takes place preferentially along the direction of arrow 220'.

It will be realized that metallization of the plastics materials may take place on one or both surfaces of sheets 202 and 218 and is particularly useful on the surfaces that are in contact with the thermo-sensitive lacquer to help adhesion. However if not present there may be the advantage of being able to visually inspect for the presence of the non-evaporated getter material. Furthermore the vessel 200 can be inspected for any change of physical form or colour to indicate whether the getter material has sorbed gas due to a defective seal.

Also the layer of adhesive may be placed on either of the two surfaces that are to be sealed for instance on either the first sheet of thermally stable material or the second sheet of thermo-retractable material.

The getter materials to be protected are any getter materials that react with residual gases but are preferably those getter materials which are alloys of barium.

Examples are the reactive non-evaporating barium getter alloys which comprise an alloy of $Ba_z+(Ba_{1-x}A_x)_nB_m$ in which, A is a metal selected from the group consisting of elements of Group IIa of the periodic table of elements, excluding barium, B is a metal selected from the group consisting of elements of Group Ib, IIb, IIIa, IVa and Va of the periodic table of elements, $n=1, 2, 3$ or 4

$m=1, 2$ or 5, $0 \leqq x \leqq 0.5$ $0 \leqq z \leqq$ such a value that the total barium is not greater than 95% by weight.

Such alloys are described in co-pending application Ser. No. 07/854,567, filed concurrently with the present application, and assigned to the assignee of the present application.

Further examples are the reactive non-evaporating barium getter alloys which comprise an alloy of $Ba_{1-x}A_xLi_{4-y}B_y$ in which;

A is a metal selected from the group consisting of elements of Group IIa of the periodic table of elements, excluding barium, and B is a metal selected from the group consisting of elements of Group IIIa, of the periodic table of elements and magnesium, and $0 \leqq x \leqq 0.8$, and $0 \leqq y \leqq 3.5$.

Such alloys are described in co-pending application Ser. No. 07/854,568, filed concurrently with the present application, and assigned to the assignee of the present application.

Modifications may be made such as that shown in FIG. 3 which shows a protective vessel 300 comprising a first sheet 302 of thermally stable material, an adhesive 304 and a second sheet 306 of thermo-retractable organic plastic material. There is also provided a grid 308 in the form of crossed bars 310, 310' which ensure that the getter material 312 remains held loosely in place when thermo-retractable material of the second sheet 306 has retracted.

Figure 4:
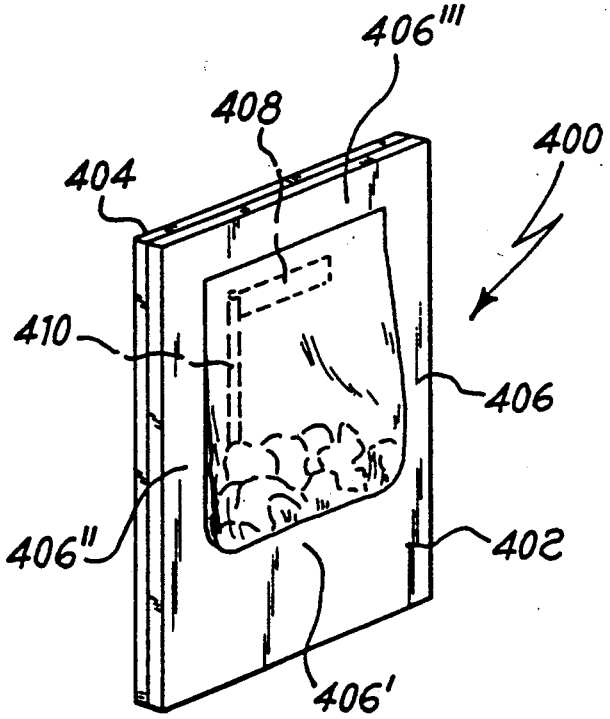
FIG. 4 is a view of yet another embodiment of the present invention.

FIG. 4 shows a protective vessel 400 comprising a first sheet 402 of thermally stable material without a depression in its surface, an adhesive (not shown) and a second sheet 404 of thermo-retractable organic plastic material. The first sheet 402 of thermally stable material is attached by borders 406, 406', 406'' and 406''' to the second sheet 404. A knife edge 408 on a support 410 is carried by the second sheet so that when the thermo-retractable material of the second sheet 404 begins to retract by an application of heat, the knife edge 408 provides a preferred rupture zone. Knife edge 408 could be replaced by a needle or other rupture provoking instrument.

EXAMPLE 1

A series of protective vessels made up of rectangular depressions 3 mm deep and measuring 3 cm×1.5 cm was manufactured in a continuous strip of laminated nylon (20 μm)-aluminium (45 μm)-PVC (60 μm) sheet from CARCANO of Mandello Lario (Como), Italy. In a glove box in an inert atmosphere of argon gas the depressions were filled with 1 gram of an alloy of $Ba_{0.5}Ca_{0.5}Al_{0.8}$ broken into pieces less than 0.5 mm in diameter.

A sheet of colourless Alfaclear OR K 265 thermo-retractable PVC strip 75 μm thick, from Alfatherm Industriale S.p.A. of Venegono Superiore (Varese), Italy, was coated on one side with VA 276 lacquer which was allowed to dry in a stream of air heated to about 40° C. It was then introduced into the glove box and each filled depression was covered with the thermo-retractable strip and caused to adhere by applying heat and light pressure to the borders of the depression at a temperature of less than 73° C. at which temperature the thermo-retractable plastics retracts, The completed protective vessels were then separated from each other.

EXAMPLE 2

A protective vessel manufactured according to example 1 was placed in an evacuated enclosure. It was heated and when the thermo-retractable material reached 73° C. it retracted by 50% in length to expose the getter alloy to unwanted gas.

Thus getter materials protected by protective vessels of the present invention can be placed in any enclosures in which a vacuum must be produced, or preserved and where temperatures cannot be allowed to rise above about 150° C. The temperatures above 150° C. causes excessive outgassing or degassing and production of gases due to thermal decomposition of the constructional components of the enclosure. Such enclosures may be, for instance, those used in vacuum insulation in the mass markets of industrial domestic refrigerators or deep-freezers, and anywhere where organic or inorganic insulating materials are used under vacuum conditions, insulated double glass panels, walls of transport vehicles and the like and housing and building thermal insulation in general.

The scope of the claims is meant to cover the protective vessel both when the sheet of thermo-retractable plastics material encloses the getter material and also when the protective vessel has been heated such that the thermo-retractable material has undergone retraction, exposing the getter material to residual gases.

Although the invention has been described in considerable detail with reference to certain preferred embodiments designed to teach those skilled in the art how best to practice the invention, it will be realized that other modifications may be employed without departing from the spirit and scope of the appended claims.

What is claimed is:

1. A protective vessel for a getter material comprising:

i) a first sheet of thermally stable material which is attached to;

ii) an adhesive, which in turn is attached to;

iii) a second sheet of thermo-retractable plastics material, said first and second sheets enclosing said getter material.

2. A protective vessel of claim 1 in which the thermally stable material is metal.

3. A protective vessel of claim 1 in which the thermally stable material is aluminium.

4. A protective vessel of claim 1 in which the thermally stable material is a plastics material.

5. A protective vessel of claim 1 in which the thermally stable material is polyvinylchloride.

6. A protective vessel of claim 1 in which the thermally stable material is polyethylene.

7. A protective vessel of claim 1 in which the thermally stable material is polystyrene.

8. A protective vessel of claim 1 in which the thermally stable material is laminated nylon-aluminium-PVC.

9. A protective vessel of claim 1 in which the thermally stable material has a depression for containing the getter material.

10. A protective vessel of claim 1 in which the adhesive is a lacquer which has a point of adhesion which is above room temperature but less than the thermo-retraction temperature of the thermo-retractable plastics material.

11. A protective vessel of claim 10 in which the lacquer is polyurethane dissolved in ethyl acetate.

12. A protective vessel of claim 1 in which the thermo-retraction temperature of the thermo-retractable material is less than 150° C.

13. A protective vessel of claim 1 in which the getter material remains held in place when the thermo-retractable material has retracted.

14. A protective vessel of claim 1 in which is provided a rupture-provoking instrument.

15. The vessel of claim 1 wherein argon surrounds and protects the getter material.

16. A temporary protective vessel for protecting a reactive, non-evaporating barium getter alloy from unwanted gas until exposure thereto; said vessel comprising:

I. a first sheet of thermally stable rigid organic plastic material having an upper surface surrounding a depression containing the reactive, non-evaporating barium getter alloy, leaving a border in the upper surface, which first sheet is attached to:

II. a thermo-sensitive lacquer whose point of adhesion is above room temperature but less than the thermo-retraction temperature of a second sheet of thermo-retractable organic plastic material and which in turn is attached to:

III. a second sheet of thermo-retractable organic plastic material conforming with the upper surface of said first sheet;

such that upon heating the protective vessel to a temperature of less than 150° C. the thermo-retractable organic plastic material retracts to expose the reactive, non-evaporating barium getter alloy to residual gas.

17. A temporary protective vessel for protecting a reactive, non-evaporating barium getter alloy from residual gas until exposure thereto, said vessel comprising:

I. a first rectangular sheet of thermally stable rigid polyvinylchloride, said first rectangular sheet having:

i) an upper surface coated with a layer of evaporated aluminium; and ii) a rectangular depression containing the reactive, non-evaporating barium getter alloy, leaving a border in the upper surface having four sides, two of which are parallel sides and of substantially equal width, and another two of which are parallel but one side being of greater width; and which is attached to:

II. a thermo-sensitive lacquer, covering said evaporated aluminium whose point of adhesion is above room temperature but is less than the thermo-retraction temperature of a second rectangular sheet of thermo-retractable organic plastic material and which in turn is attached to:

III. a second rectangular sheet of thermo-retractable organic plastic material conforming with the upper surface of said first rectangular sheet, the direction of retraction being parallel with the two said parallel sides of substantially equal width; such that upon heating the protective vessel to a temperature of less that 150° C. the thermo-retractable organic plastic material retracts to expose the reactive, non-evaporating barium getter alloy to unwanted gas.

18. A temporary protective vessel for a reactive, non-evaporating barium getter alloy; said vessel comprising:

i) a first sheet of thermally stable material which is attached to:

ii) an adhesive, which in turn is attached to:

iii) a second sheet of thermo-retractable plastic material, said first and second sheets enclosing said reactive, non-evaporating barium getter alloy wherein the reactive non-evaporating barium getter alloy comprises an alloy of $Ba_z+(Ba_{1-x}A_x)_nB_m$ wherein:

A is a metal selected from the group consisting of elements of Group IIa of the periodic table of elements, excluding barium; and B is a metal selected from the group consisting of elements of Group Ib, IIb, IIIa, IVa and Va of the periodic table of elements; and $n=1, 2, 3$, or 4; and $m=1, 2$, or 5; and $0 \leqq x \leqq 0.5$; and $0 \leqq z \leqq$ such a value that the total barium is not greater than 95% by weight.

19. A temporary protective vessel for a reactive, non-evaporating barium getter alloy; said vessel comprising:

i) a first sheet of thermally stable material which is attached to:

ii) an adhesive, which in turn is attached to:

iii) a second sheet of thermo-retractable plastic material, said first and second sheets enclosing said reactive, non-evaporating barium getter alloy wherein the reactive non-evaporating barium getter alloy comprises an alloy of $Ba_z+(Ba_{1-x}A_x)_nB_m$ wherein:

A is a metal selected from the group consisting of elements of Group IIa of the periodic table of elements, excluding barium; and B is a metal selected from the group consisting of elements of Group Ib, IIb, IIIa, IVa and Va of the periodic table of elements; and $n=1, 2, 3$, or 4; and $m=1, 2$, or 5; and $0 \leqq x \leqq 0.5$; and $0 \leqq z \leqq$ such a value that the total barium is not greater than 95% by weight.

20. A temporary protective vessel for a reactive, non-evaporating barium getter alloy; said vessel comprising:

i) a first sheet of thermally stable material which is attached to:

ii) an adhesive, which in turn is attached to:

iii) a second sheet of thermo-retractable plastic material, said first and second sheets enclosing said reactive, non-evaporating barium getter alloy wherein the reactive non-evaporating barium getter alloy comprises an alloy of $Ba_{1-x}A_xLi_{1-y}B_y$ wherein:

A is a metal selected from the group consisting of elements of Group IIa of the periodic table of elements, excluding barium; and B is a metal selected from the group consisting of elements of Group IIIa, of the periodic table of elements and magnesium; and $0 \leqq x \leqq 0.8$, and $0 \leqq y \leqq 3.5$.

21. A temporary protective vessel for a reactive, non-evaporating barium getter alloy; said vessel comprising:

i) a first sheet of thermally stable material which is attached to:

ii) an adhesive, which in turn is attached to:

iii) a second sheet of thermo-retractable plastic material, said first and second sheets enclosing said reactive, non-evaporating barium getter alloy wherein the reactive non-evaporating barium getter alloy comprises an alloy of $Ba_{1-x}A_xLi_{1-y}B_y$ wherein:

A is a metal selected from the group consisting of elements of Group IIa of the periodic table of elements, excluding barium; and B is a metal selected from the group consisting of elements of Group IIIa, of the periodic table of elements and magnesium; and $0 \leqq x \leqq 0.8$, and $0 \leqq y \leqq 3.5$.

* * * * *